US005794552A

United States Patent [19]

Owaki

[11] Patent Number: 5,794,552

[45] Date of Patent: Aug. 18, 1998

[54] EMBROIDERY DATA PROCESSING DEVICE

[75] Inventor: Ryoji Owaki, Kasugai, Japan

[73] Assignee: Brother Kogyo Kabushiki Kaisha, Aichi-Ken, Japan

[21] Appl. No.: 740,731

[22] Filed: Nov. 4, 1996

[30] Foreign Application Priority Data

Nov. 4, 1995 [JP] Japan ..... 7-309942

[51] Int. Cl.[6] ..... D05B 21/00; D05C 5/02

[52] U.S. Cl. ..... 112/102.5; 112/445; 364/470.09

[58] Field of Search ..... 112/445, 453, 112/454, 456, 102.5, 458, 470.06; 364/470.07, 470.09

[56] References Cited

U.S. PATENT DOCUMENTS 4,341,170 7/1982 Beckerman et al. ..... 112/445
4,869,188 9/1989 Hyodo ..... 112/445
5,078,067 1/1992 Nakashima ..... 112/447 X
5,228,403 7/1993 Sugimoto ..... 112/454 X

FOREIGN PATENT DOCUMENTS 1139855 6/1989 Japan .

*Primary Examiner*—Peter Nerbun
*Attorney, Agent, or Firm*—Kane, Dalsimer, Sullivan, Kurucz, Levy, Eisele and Richard, LLP

[57] ABSTRACT

Disclosed is an embroidery data processing device having a displaying device which displays an image of an embroidery pattern, and an indicator which indicates a color of a thread to be used for forming the embroidery pattern displayed on the displaying device. The displaying device can be a conventional monochrome LCD, and the indicator indicates the color of the thread by emitting light having the same color of the thread.

10 Claims, 11 Drawing Sheets

FIG. 3

24

CATEGORY: ANIMAL

| |
|---|
| TOP ADDRESS OF DISPLAYING DATA OF1st EMBROIDERY DATA<br>TOP ADDRESS OF EMBROIDERING DATA OF1st EMBROIDERY DATA |
| TOP ADDRESS OF DISPLAYING DATA OF 2nd EMBROIDERY DATA<br>TOP ADDRESS OF EMBROIDERING DATA OF 2nd EMBROIDERY DATA |
| TOP ADDRESS OF DISPLAYING DATA OF 3rd EMBROIDERY DATA<br>TOP ADDRESS OF EMBROIDERING DATA OF 3rd EMBROIDERY DATA |
| ⋮ |
| DISPLAYING DATA OF 1st EMBROIDERY DATA |
| DISPLAYING DATA OF 2nd EMBROIDERY DATA |
| DISPLAYING DATA OF 3rd EMBROIDERY DATA |
| ⋮ |
| COLOR CODE OF 1st EMBROIDERY DATA |
| COLOR CODE OF 2nd EMBROIDERY DATA |
| COLOR CODE OF 3rd EMBROIDERY DATA |
| ⋮ |
| EMBROIDERING DATA OF 1st EMBROIDERY DATA |
| EMBROIDERING DATA OF 2nd EMBROIDERY DATA |
| EMBROIDERING DATA OF 3rd EMBROIDERY DATA |
| ⋮ |

EMBROIDERY DATA PROCESSING DEVICE

BACKGROUND OF THE INVENTION

The present invention relates to an embroidery data processing device provided with a displaying device for displaying color of threads.

Conventionally, electronically controlled sewing machines provided with large color displays are known. In such sewing machines, various kinds of stitching patterns such as a plurality of practical stitching patterns, various decorative stitching patterns, a plurality of one point patterns, character patterns, are stored in a non-volatile memory as a sewing pattern data. When a user uses the sewing machine to make an embroidery, the user operates a key for selecting a kind of patterns first. Then the stitching patterns in the selected kind are shown on a display of the sewing machine. From the displayed patterns, the user selects desired pattern(s) to uses.

Recently, sewing machines provided with a large color displays have been suggested. The color display is used for displaying the color image of the embroidery and cloths onto which the embroidery is formed. An example of such a sewing machine is disclosed in Japan Patent Provisional Publication HEI1-139855. In the Provisional publication, disclosed is a color image displaying device for a sewing machine provided with a large color displaying device, a color sensor for detecting color of the upper threads, and another color sensor for detecting color of the cloth. The background color on the display is set to the same color as that of the cloth, and the embroidery image having the same color as the color of the thread to be used is superimposed on the background on the displaying device.

In the above-described Japan Patent Provisional Publication HEI1-139855, since the background color of the display is set similar to the color of the cloth, and the color image of the embroidery is superimposed on the background color, a control device for the color image should be incorporated in the sewing machine. Further, if the entire image of the embroidery is to be displayed, the displaying device should have a large displaying screen (e.g., an LCD:Liquid Crystal Display). Still further, in order to display the color image of the embroidery and the cloth, controlling of the displaying device is complicated. Accordingly, if the color image displaying device is employed, cost of the sewing machine is increased. Furthermore, depending on the colors of the cloth and the embroidery, halation may occur, and the image of the embroidery may be displayed unclear.

SUMMARY OF THE INVENTION

In view of the above, it is an object of the present invention to provide an improved embroidery data processing device which enables a user to visually recognize a selected stitching pattern or at least a part of the selected stitching pattern and colors of the selected stitching pattern or the part of the selected stitching pattern without increasing the cost.

For the above object, according to the invention, there is provided an embroidery data processing device, comprising: a displaying device for displaying image of an embroidery pattern in accordance with an embroidery data; at least one indicator, provided separately from the displaying device, for displaying a color of a thread which is to be used for forming the embroidery pattern displayed on the displaying device.

Since the indicator indicates the color of the thread to be used for forming the embroidery patter, the displaying device can be a device which only displays a monochrome image of the embroidery pattern.

Optionally, the indicator can be constructed such that it indicates the color by emitting light having the color. Specifically, the indicator may have a plurality of LEDs (Light Emitting Diodes) capable of emitting a plurality of colors, respectively, and wherein the light having the color is a combination of lights emitted by the plurality of LEDs.

Alternatively, a color LCD or other device can also be used if it can display color. In this regard, the indicator is not necessarily one which can display an image of the pattern.

Further optionally, the embroidery pattern may include a plurality of components to be embroidered with threads having different colors, and in such a case the indicator may indicate a color of one of the components.

Furthermore, the displaying device may display images of the plurality components separately, and the indicator may indicate a color of a component displayed at a predetermined position on the displaying device.

Still optionally, the indicator and the displaying device can be arranged such that the indicator is closer to the image displayed at the predetermined position than to other images.

Further, when embroidering of the image displayed at the predetermined position is finished, the image disappears from the displaying device, and another image of remaining components is displayed at the predetermined position on the displaying device.

Alternatively, the embroidery pattern may include a plurality of components to be embroidered with threads having different colors, and a plurality of indicators are provided such that the plurality of indicators indicate colors of threads to be used for embroidering the plurality of components, respectively.

Optionally, the images of the plurality of components are arranged in a line, and the plurality of indicators a arranged to be located adjacent to respective images of the components.

According to another aspect of the invention, there is provided an embroidery data processing device, comprising: a memory for storing embroidery data for a plurality of embroidery patterns and threads to be used for forming the plurality of embroidery patterns; a selector for selecting one of the embroidery patterns; a displaying device for displaying image of the one of the embroidery patterns selected by the selector; an indicator capable of indicating a plurality of colors, the indicator being provided separately from the displaying device; and a controller for the indicator, the controller controls the indicator to indicate a color of a thread to be used for forming the selected one of the embroidery patterns based on the embroidery data.

DESCRIPTION OF THE ACCOMPANYING DRAWINGS

FIG. 3 is a chart illustrating structure of an embroidery data stored in a card ROM;

DESCRIPTION OF THE EMBODIMENT

Figure 1:
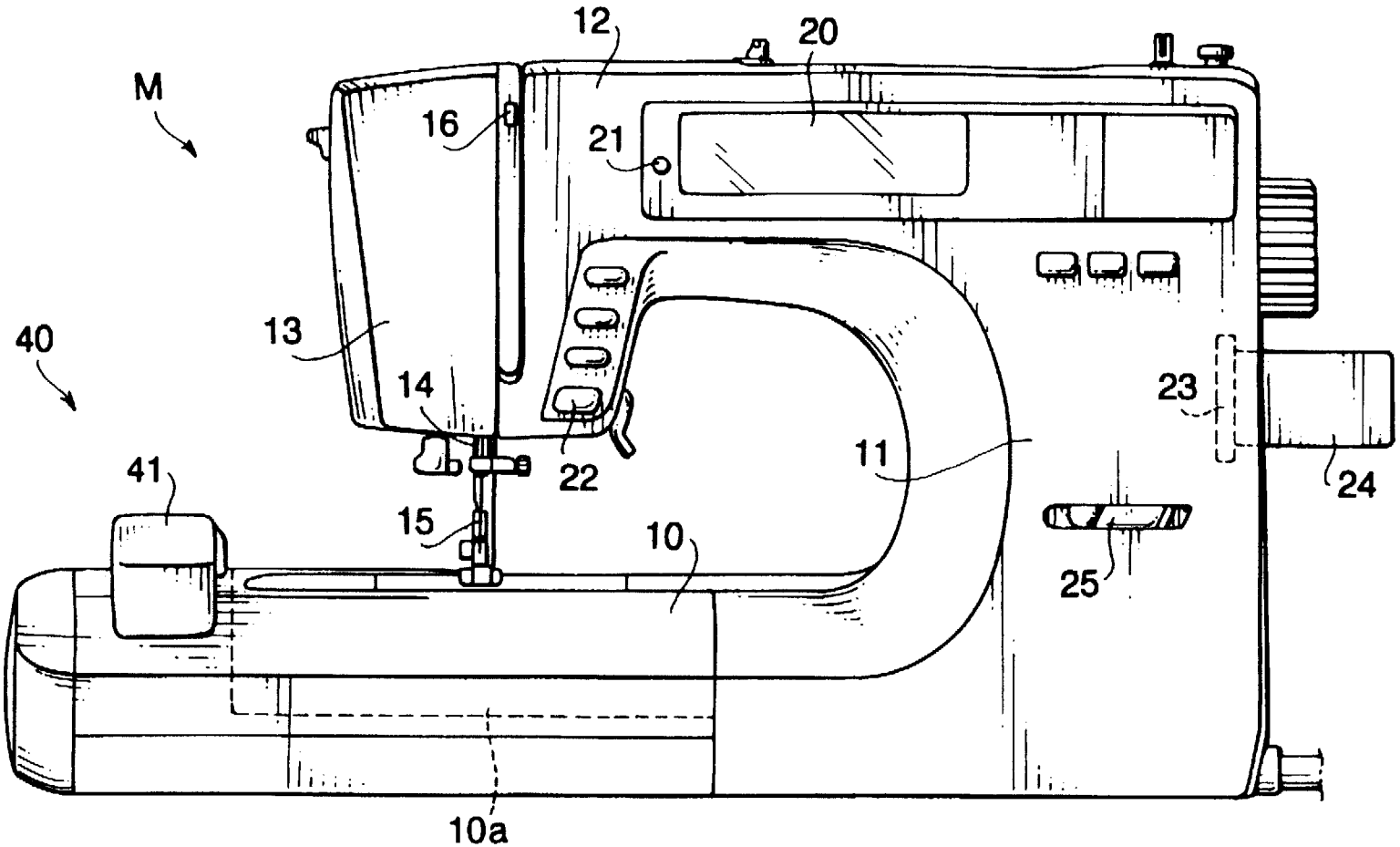
FIG. 1 is a schematic side view of an electronically controlled sewing machine provided with an embroidery data processing device embodying the present invention.

FIG. 1 is a schematic side view of an electronically controlled sewing machine M provided with an embroidery data processing device embodying the present invention.

The electronically controlled sewing machine M has a bed portion 10, an upright portion 11, and an arm portion 12. The bed portion 10 has forwarding mechanism (not shown) and the like. The teeth mechanism is moved in up and down directions by an up-down mechanism (not shown) and is also moved in forward and backward directions by an forward-backward mechanism (not shown).

The arm portion 12 has a needle rod driving mechanism which drives a needle rod 14 in up and down directions in the drawing. To the needle rod 14, a sewing needle 15 is secured. The needle rod 14 is reciprocally moved in the up and down directions perpendicular to the cloth feeding direction by a reciprocal driving mechanism which is also provided in the arm portion 12. Further, a take-up driving mechanism (not shown) for driving the take-up eyelet 16 synchronously with the movement of the needle rod 14 is provided in the arm portion 12. The needle rod driving mechanism and the take-up eyelet driving mechanism, the teeth up-down mechanism are driven by a main motor 26 (see FIG. 2); and the reciprocal driving mechanism is driven by a needle rod reciprocating motor 27. The teeth forward and backward driving mechanism is driven by a teeth driving motor 28 (see FIG. 2).

On a front surface of the arm portion 12, an LCD (Liquid Crystal Display) 20 is provided. On the LCD 20, various embroidery patterns and various messages are displayed as a monochrome image, or a black-and-white image. Covering the image displaying area of the LCD 20, a plurality of touch keys 20*a* composed of transparent electrodes are provided. When an embroidery pattern is to be selected, embroidery patterns are displayed on the LCD 20. By touching the touch key 20*a* corresponding to the desired pattern, the user can select the embroidery pattern. When a function of the sewing machine is to be selected, similarly to the above, a plurality of operable functions are displayed on the LCD 20. By touching the touch key 20*a* corresponding to a desired function, the user can select the function and have the sewing machine perform the function. Adjacent to the LCD 20 (on the left hand side of the LCD 20 in the drawing), a color indicator (a triple color LED) 21 is provided. The color indicator 21 is constructed such that three LED's capable of emitting light having different colors are incorporated. Combination of the color components emitted by respective LEDs, i.e., depending on the intensity of each color component, various color can be indicated by the color indicator.

In the embodiment, the color indicator 21 has a red (R), green (G) and blue (B) LED's which are integrally incorporated. Each LED has a diameter of 3 to 5 mm.

At a head part 13 of the arm portion 12, a start/stop switch 22 which is used to initiate/terminate an embroidering and/or sewing operation. In the upright portion 11, a card connector (i.e., a card receptacle) 23 to which a card ROM 24 is detachably connected is provided. Further, on the surface of the upright portion 11, a slidable lever 25 for adjusting the sewing speed of the sewing machine M is provided.

A left hand side portion of the bed portion 10 is formed to be a free arm portion 10*a* to which an embroidery unit 40 is detachably mounted. The embroidery unit 40 is used for embroidering a relatively large embroidery pattern, and has an embroidery table 41 which is movable in Y direction which is parallel to the feed and reverse direction of the cloth, and in X direction which is perpendicular to the Y direction. The embroidering table 41 holds a cloth to which the embroidery is formed. Inside of a body frame of the embroidery unit 40, a driving motor which drives the embroidering table 41 in the X direction, and another driving motor 43 which drives the embroidering table 41 in the Y direction.

Figure 2:
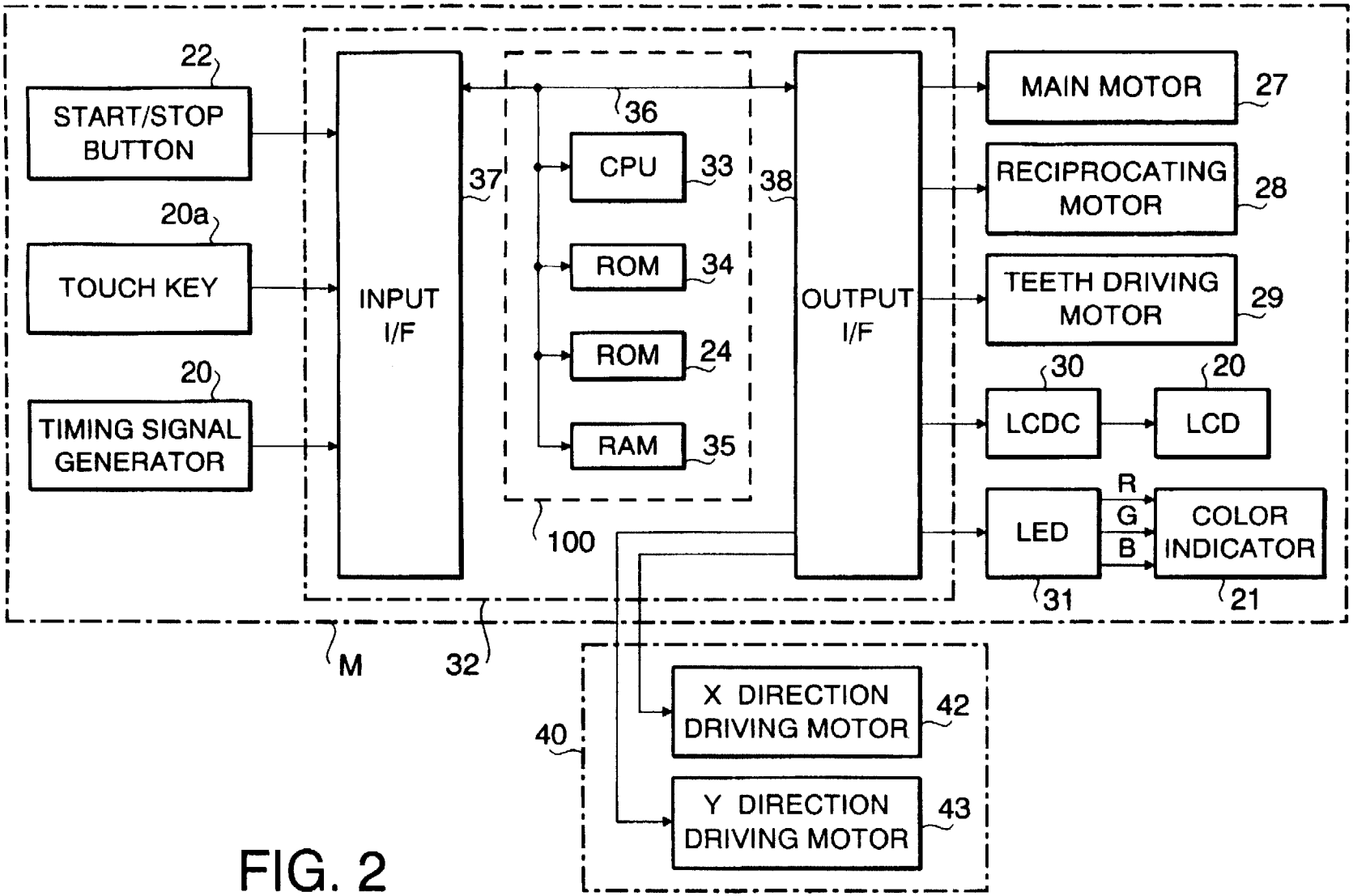
FIG. 2 is a block diagram showing a control system of the electronically controlled sewing machine.

FIG. 2 is a block diagram showing a control system of the electronically controlled sewing machine.

As shown in FIG. 2, the control system of the sewing machine M has a control unit 32. The control unit 32 includes:

- a microprocessor 100 having a CPU (Central Processing Device) 33, a ROM (Read Only Memory) 34, a RAM (Random Access Memory) 35, and a card ROM 24;
- an input interface 37 which is connected with the microprocessor 100 through a bus 36 including data bus and the like; and
- an output interface 38.

To the input interface 37, signals from the start/stop switch 22, the touch key 20*a*, and a timing signal generated by a timing signal generator 26 are transmitted. From the output interface 38, driving signals for driving the main motor 27, the needle rod reciprocating motor 28, teeth driving motor 29 are output. Further, a display controller 30 for supplying image signal to the LCD 20, and an LED driving circuit 31 for driving the color indicator 21 are driven in response to the driving signals transmitted by the microprocessor 100 through the output interface 38.

The timing signal generator 26 is provided so as to detect the rotation of an arm shaft, and output an encoded signal of the rotation of the arm shaft.

To the output interface 38, an X direction driving motor 42 and a Y direction driving motor 43 for moving the embroidery unit 40 are connected. In response to driving signals output by the control unit 32, through the output interface 38, the driving motors 42 and 43 are driven independently. As driven by the driving motors 42 and 43, the embroidery table 41 is move in X and Y directions at each stitch, various embroideries can be formed on the cloth held by the cloth holding frame.

In the card ROM 24, a plurality of one point embroidery patterns are stored. The one point embroidery patterns are categorized in, for example, "animal", "people", "letters and characters", and the like. For each category, a plurality of embroidery pattern data are stored. That is, for the category of "animal", a pattern of "panda", a pattern of "elephant", "horse", and the like are stored. The embroidery pattern data includes a displaying data to be used for displaying the embroidery patterns on the LCD 20 and the color indicator 21, and an embroidering data to be used for controlling the sewing mechanism.

FIG. 3 shows an exemplary data structure. The embroidery pattern data has address portions and data portions for each category. As shown in FIG. 3, the "animal" category includes address data of respective embroidery pattern data, i.e., a pair of top addresses of the displaying address and embroidering address for each embroidery pattern followed by the displaying data for each embroidery pattern, a thread color code for each embroidery pattern, and embroidering data for each embroidery pattern in the order. For the other categories, the embroidery pattern data is stored in the similar manner.

In the embodiment, the embroidering data is data representative of stitching points expressed in a form of an absolute or relative coordinate system. Based on the embroidering data, the cloth on which the embroidery is formed is moved relative to the needle 15.

Alternatively, the embroidering data can be made by dividing data representative of all the stitching points, or the embroidery pattern into a plurality of blocks such as triangular blocks or rectangular blocks, and making data indicative of the significant points such as summits of each block.

Figure 12A:
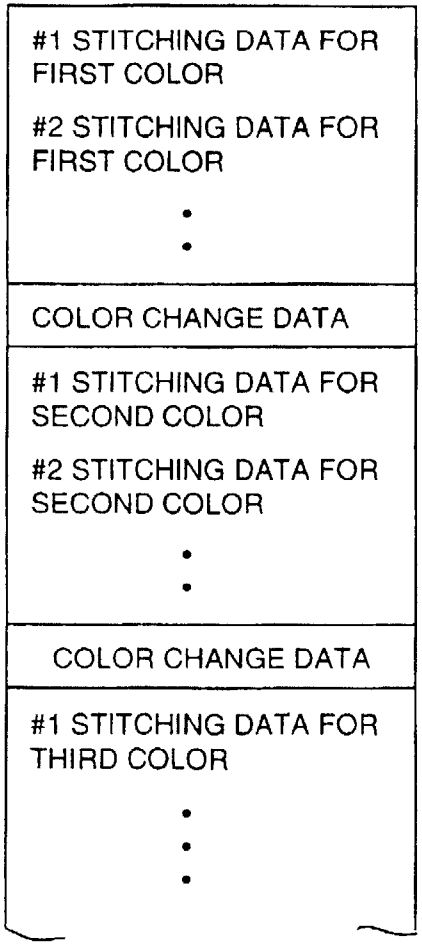
FIG. 12A shows a detailed structure of an embroidering data for one embroidery pattern.
Figure 12B:
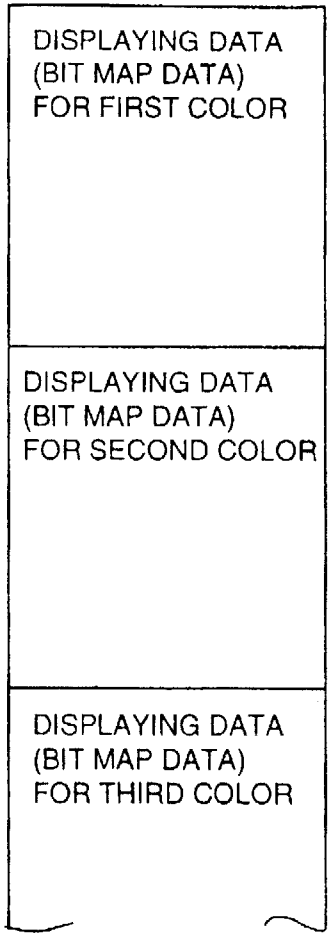
FIG. 12B shows a detailed structure of a displaying data for one embroidery pattern.
Figure 12C:
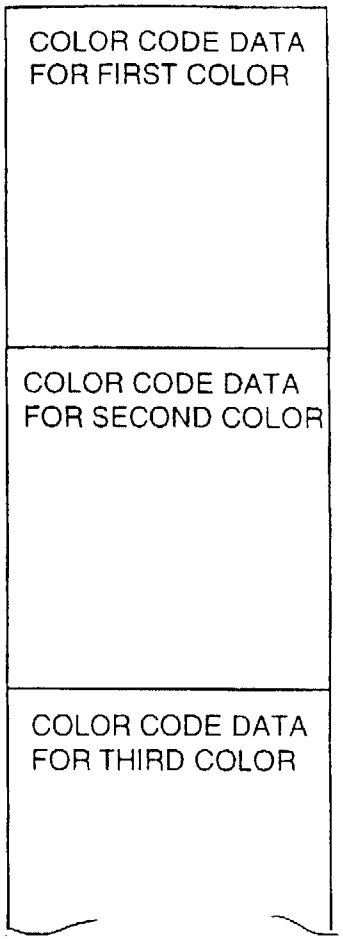
FIG. 12C shows a detailed structure of a color code data for one embroidery pattern.

In the embodiment, each displaying data, each color code, and each embroidering data are divided into component data in accordance with colors of threads to be used. As shown in FIG. 12A, the embroidering data includes stitching data for first color, color change data, stitching data for second color, color change data, and the like. The embroidering data is therefore divided into stitching data for respective colors. Similar to the above, as shown in FIG. 12B, the displaying data includes a displaying data for the first color, a displaying data for the second color, and the like. The color code data is also divided into a color code data for the first color, a color code for the second color, and the like. That is, the data for each embroidery pattern includes the color component data, i.e., the stitching data, displaying data and displaying data for respective color.

In the ROM 34, as mentioned above, various programs are stored. For example, a control program for executing display control which is a significant feature of the embodiment, and programs for controlling sewing operations are stored in the ROM 34. The sewing operation control programs control the sewing machine M such that the driving motors 27 ad 28 are operated to executed practical stitch such as zigzag stitch, triple stitch or the like in accordance with a practical stitch data in the embroidery data, and that the driving motors 42 and 43 are operated in accordance with the decorative stitch data in the embroidery data. Further, in the ROM 34, thread color indication data corresponding to thread colors are stored. The thread color indication data is used for indicating the color of one of thirty different color threads to be used with the color indicator 21. The color indicator includes duty ratios of driving signals to be applied to each of the R, G and B LEDs.

The RAM 33 includes various memory areas used as buffers, counters and the like for performing controls for displaying and forming the embroidery patterns.

Figure 4:
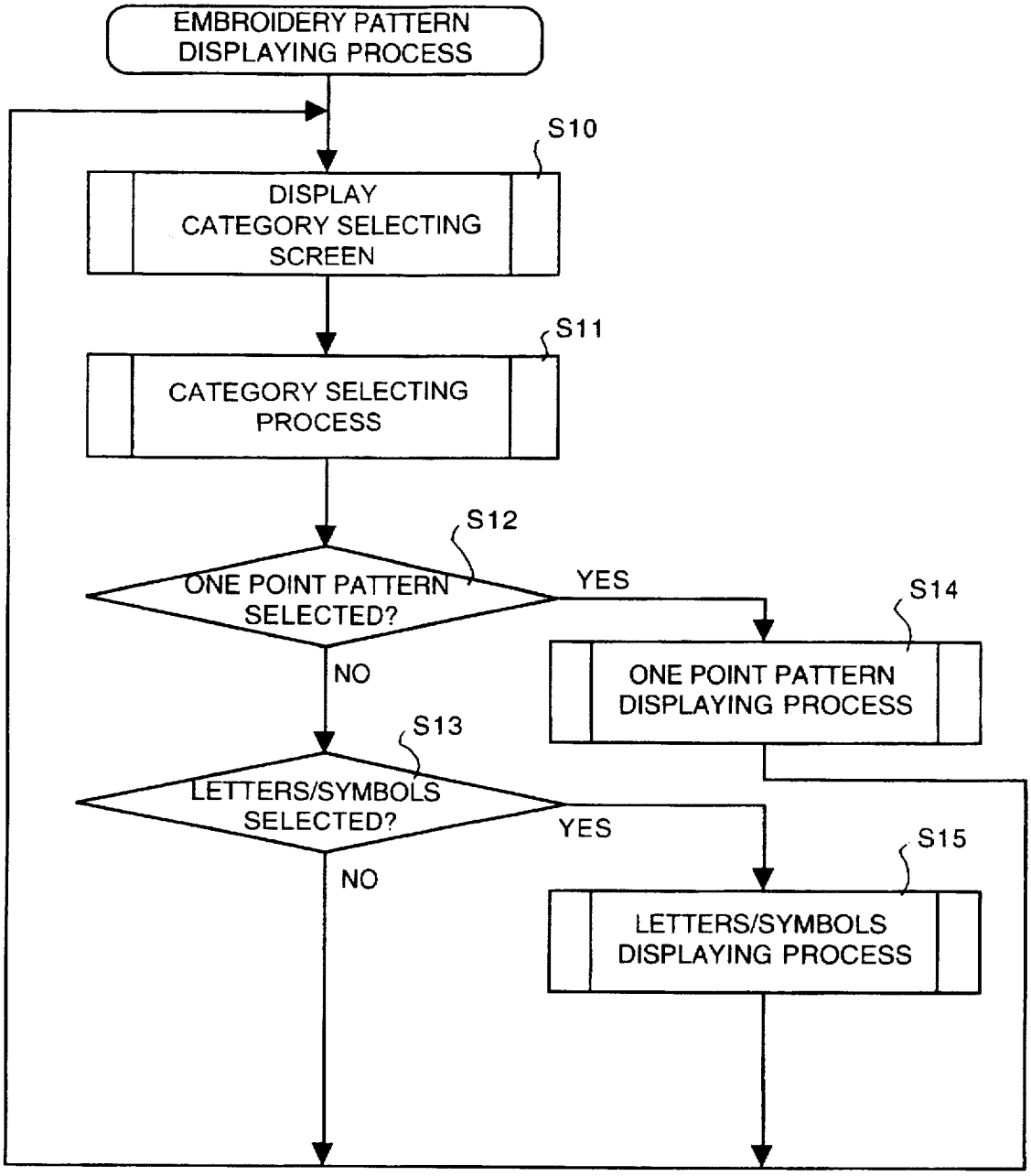
FIG. 4 is a flowchart illustrating a process for displaying the embroidery data.

FIG. 4 is a flowchart illustrating a process for displaying the embroidery data.

Figure 8:
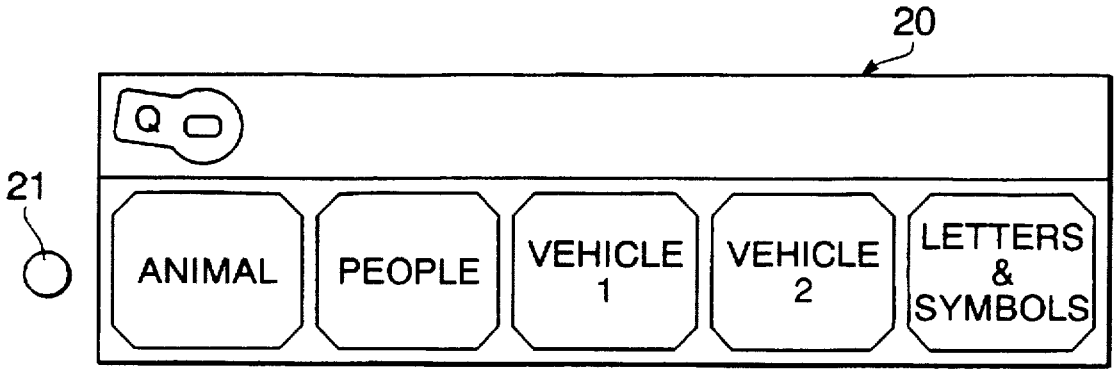
FIG. 8 is an exemplary screen image in which kinds of the embroidery patterns are indicated by name.

When power is supplied to the sewing machine M, process shown in FIG. 4 is initiated. At step S10, the CPU 33 controls the LCD controller 30 to display a pattern selecting screen on the LCD 20. FIG. 8 shows an exemplary screen image shown at S10. In FIG. 8, categories of "animal", "people", "vehicle 1", "vehicle 2", "letters and symbols" are shown. When the user of the sewing machine touches one of the touch keys 20*a* provided in front of the displayed categories, the CPU 30 proceeds to step S11 where a pattern selecting process is executed. The pattern selecting process will be described in detail later.

Figure 5:
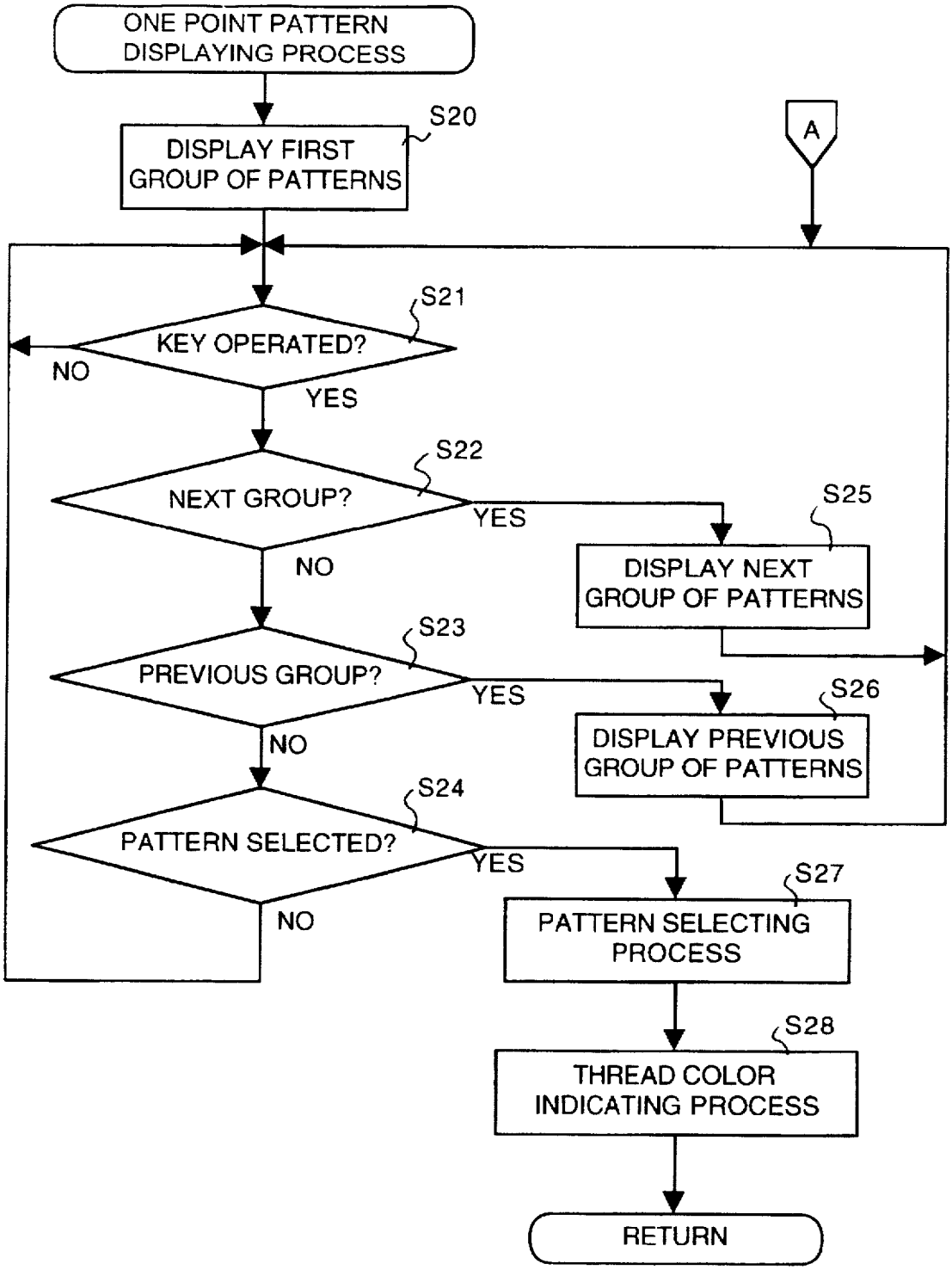
FIG. 5 is a flowchart illustrating a process for displaying an one-point embroidery pattern.

If the pattern selected at S11 is a one point embroider pattern (S12:YES), the CPU 30 executes a one point embroidery pattern displaying process at S14. FIG. 5 shows a flowchart illustrating the one point embroidery pattern displaying process.

Figure 9:
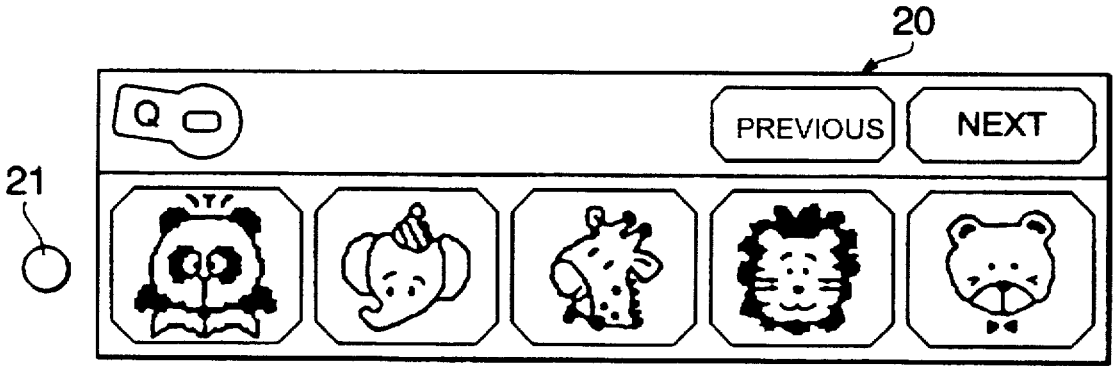
FIG. 9 is an exemplary screen image of "animal" group of the embroidery patterns.

When the one point embroidery pattern displaying process initiated, a first group of embroidery patterns in the selected category are displayed on the LCD 20 (S20). For example, if the category "animal" is selected, within various patterns belonging to the category, the first group of the embroidery patterns, which are stored in the card ROM 24, are displayed on the LCD 20 as shown in FIG. 9. On the screen of the LCD 20, together with the group of the embroidery patterns, image of two buttons, "previous" and "next" buttons for displaying previous and next group of patterns are displayed. When the user touches the touch key 20*a* in front of the "previous" or "next" button images, the previous or next group of the embroidery patterns will be displayed on the LCD 20 (S22, S25, S23 and S26).

Figure 6:
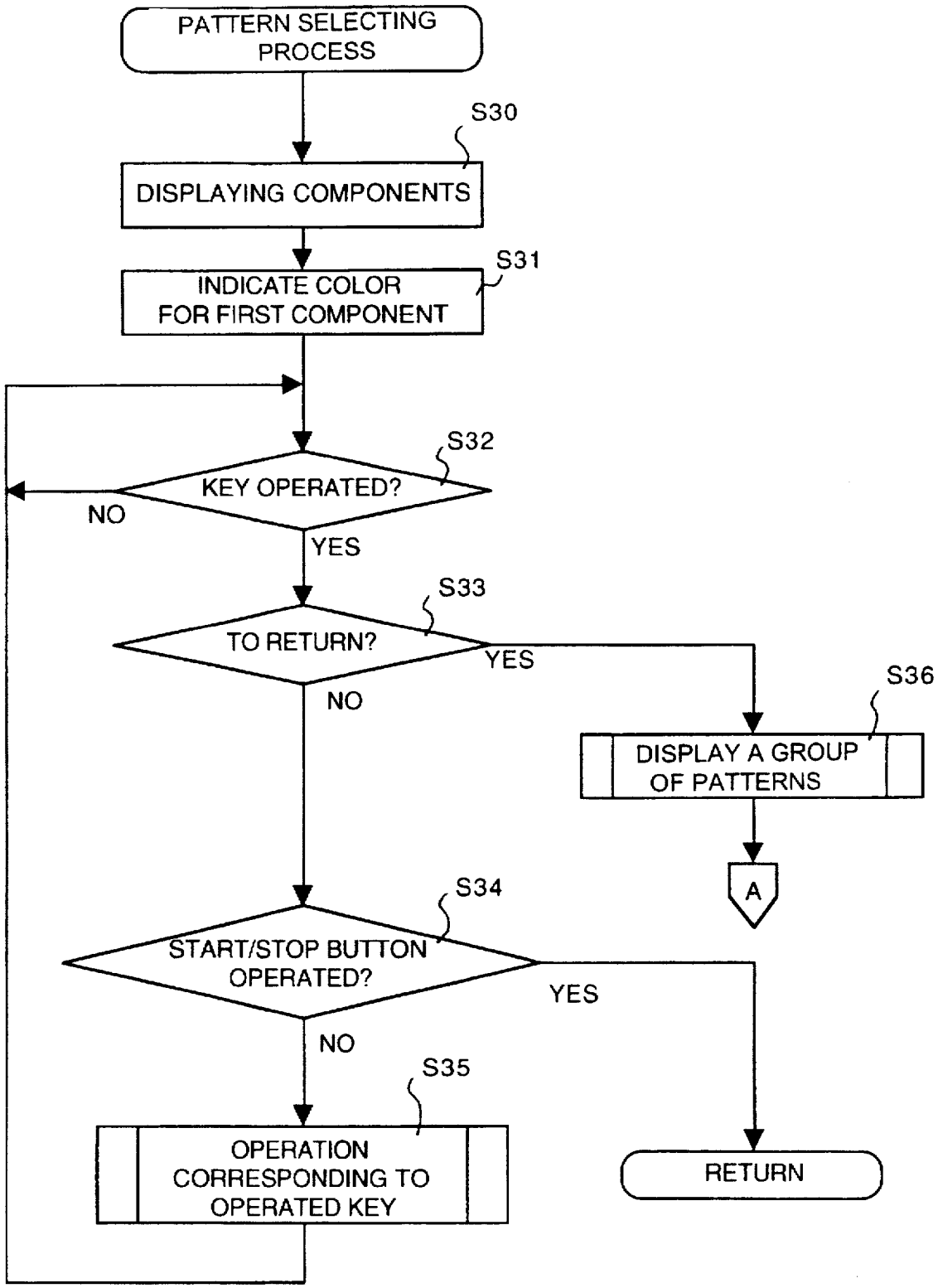
FIG. 6 is a flowchart illustrating a process for selecting embroidery pattern.

If a touch key 20*a* corresponding to one of the displayed embroidery patterns (S24:YES), the CPU 30 executes, at S27, an embroidery pattern selecting process which is shown in FIG. 6.

FIG. 6 is a flowchart illustrating an embroidery pattern selecting process.

Figure 10A:
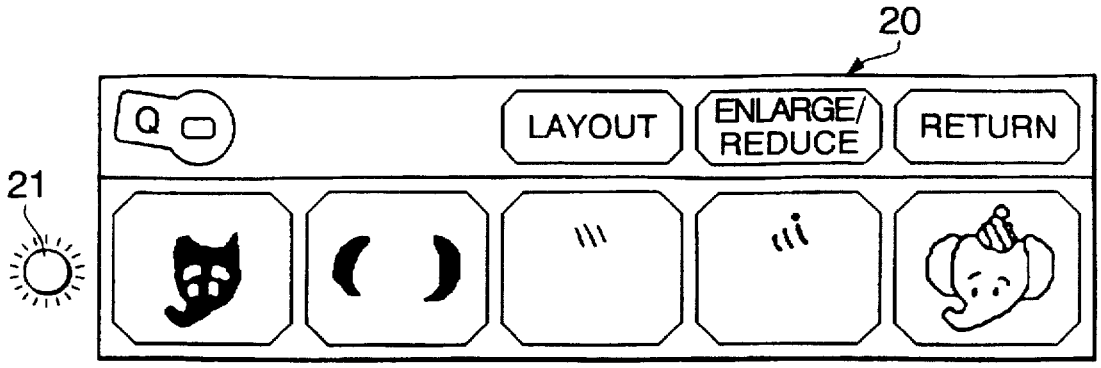
FIG. 10A is a screen image when the thread color of a first part of the embroidery pattern (elephant) is indicated by a color indicator.

The one point embroidery pattern includes a plurality of color components having different colors, i.e., to be stitched with different color threads. When the embroidery pattern selecting process starts, the CPU 30 reads data corresponding to the selected embroidery pattern out of the card ROM 24, and displays figures for each color component aligned in the order where the stitching is executed (S30). For example, when an "elephant" is selected, five components of the "elephant" are displayed as shown in FIG. 10A. At this stage, together with the components of the "elephant", or the selected embroidery pattern, a layout button image, enlarge/reduce button image, and return button image are displayed on the screen of the LCD 20. Further, the color of the thread corresponding to a component which is displayed at the leftmost area is indicated by the color indicator 21. That is, the CPU 30 reads color indicating data corresponding to a thread to be used for forming the component shown at the leftmost position on the LCD 20, and then transmits a driving signal to the LED driving circuit 31. In response to the driving signal, the LED driving circuit 31 output color component signal to the respective LEDs, thereby the indicator 21 emits light having the color corresponding to the thread of the component shown at the leftmost position of the LCD 20.

If the user touches the touch key 20*a* confronting the return button image (S32:YES; S33:YES), the components displayed on the screen of the LCD 20 disappear, and the group of the embroidery patterns including the pattern having been selected are displayed (S36), and then control return to S21 of FIG. 5. Thereafter, the user can select an embroidery pattern as described before.

If the user touches the touch key 20*a* confronting the area other than the return button image, start/stop button 22 (S32:YES; S33:NO; S34:NO), operation corresponding to the button image facing the touched key 20*a* is executed (S35), and control returns to S32.

When the user touch the key 20*a* corresponding to the start/stop button 22 (S32:YES; S33:NO; S34:YES) after the thread having the same color as indicated by the color indicator 21 is loaded in the sewing machine, the CPU 30 receives a command instructing to start embroidering operation. At this stage, the process is finished, and control returns to where it was called, i.e., S27 of FIG. 5, and control proceeds to S28 of FIG. 5. The CPU 30 starts driving the main motor 27 and the embroidery unit 40 to start embroidering operation. At S28 of FIG. 5, the CPU 40 starts a color indication process.

Figure 7:
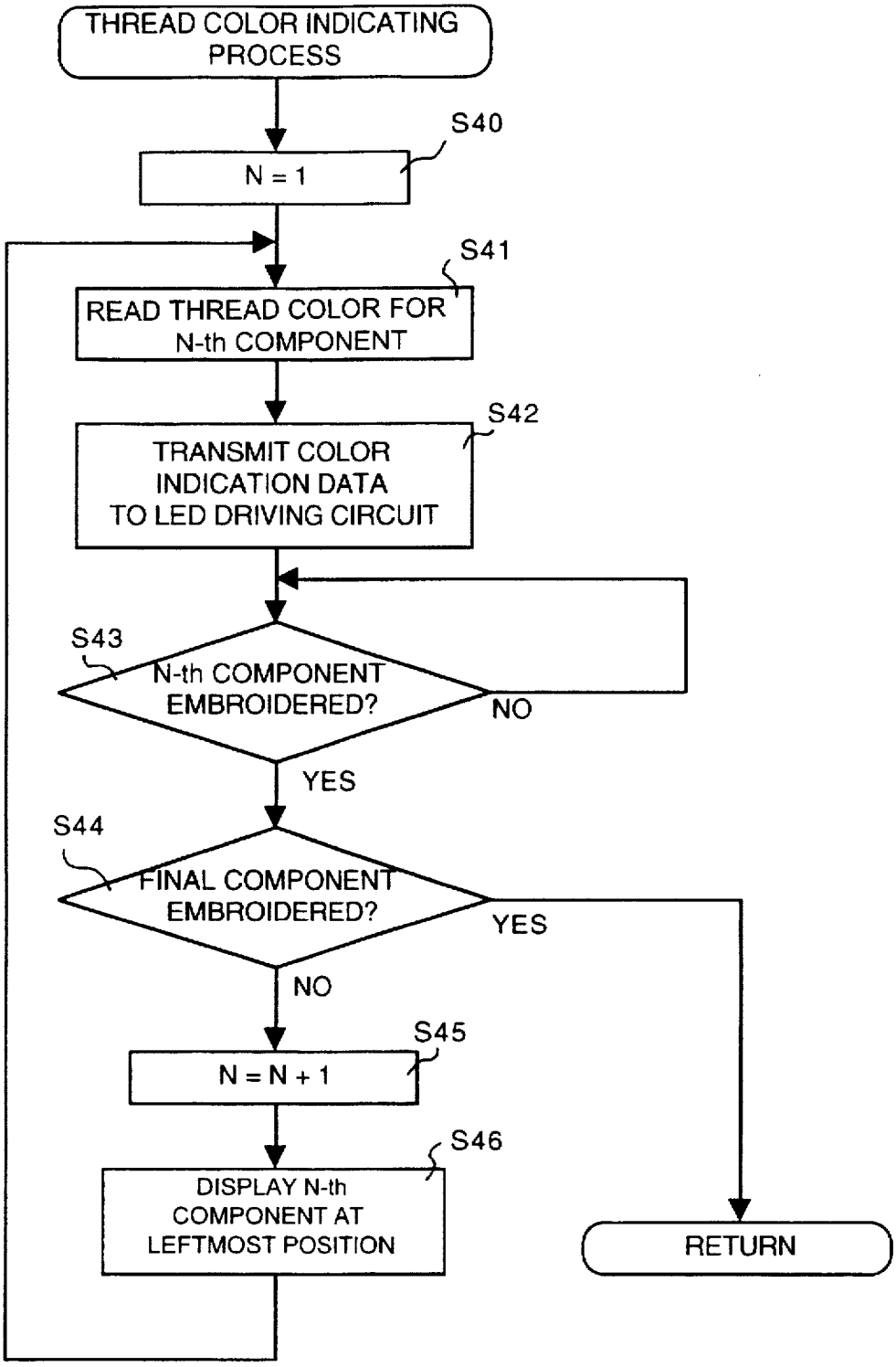
FIG. 7 is a flowchart illustrating a process for displaying thread color.

FIG. 7 is a flowchart illustrating the thread color indication process for indicating the thread color.

When the thread color indication process starts, a pointer value N is set to an initial value "1" (one). The pointer is used for indicating the components displayed on the screen of the LCD 20 at S40. Then at S41, the CPU 30 reads the color code for the N-the component, and transmits the color indication data corresponding to the thread color of the component to the LED driving circuit 31 (S42). Accordingly, the color indicator 21 indicates the color of the thread corresponding to the component, which is being embroidered and displayed at the leftmost position on the screen of the LCD 20. For example, as shown in FIG. 10A, among five components of the "elephant", the color (e.g., yellow) of the leftmost component is indicated by the color indicator 21.

Figure 10B:
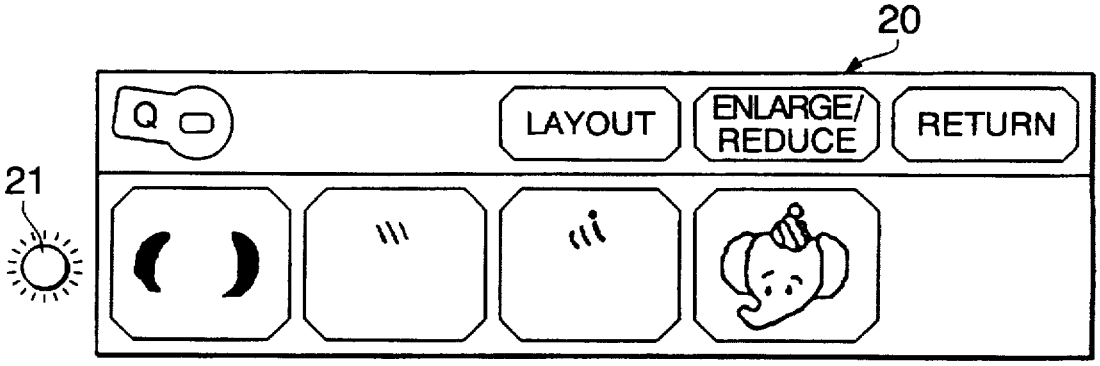
FIG. 10B is a screen image when the thread color of a second part of the embroidery pattern (elephant) is indicated by a color indicator.

When the embroidering of the N-the component is finished (S43:YES), and embroidering operation is temporarily paused since the threads are exchanged, the CPU 30 determines whether embroidering of the all the components are finished (S44). If the components having been embroidered is not the last component (S44:NO), the pointer N is incremented by one (S45), the component previously shown at the leftmost position is deleted, image of the remaining components are shifted leftward so that the next component is shown at the leftmost position on the screen of the LCD 20 (S46). Thereafter, the color of the thread to be used for forming each of the remaining components is indicated one by one in steps S41 through S46. For example, as shown in FIG. 10B, among the five components shown in FIG. 10A, the first component disappears, and the remaining four components are shifted on the LCD 20. Accordingly, in FIG. 10B, the component of ears is located at the leftmost position on the screen of the LCD 20, and the color thereof (e.g., green) is indicated by the color indicator 21.

When the color indicator indicates the color of the repositioned components, the user is to exchange threads from a previous one to one having the same color as indicated by the color indicator 21, and then touch the touch key 20*a* in front of the stop/start button 22 displayed on the LCD 20. The similar operations are to be done for each components.

Figure 10C:
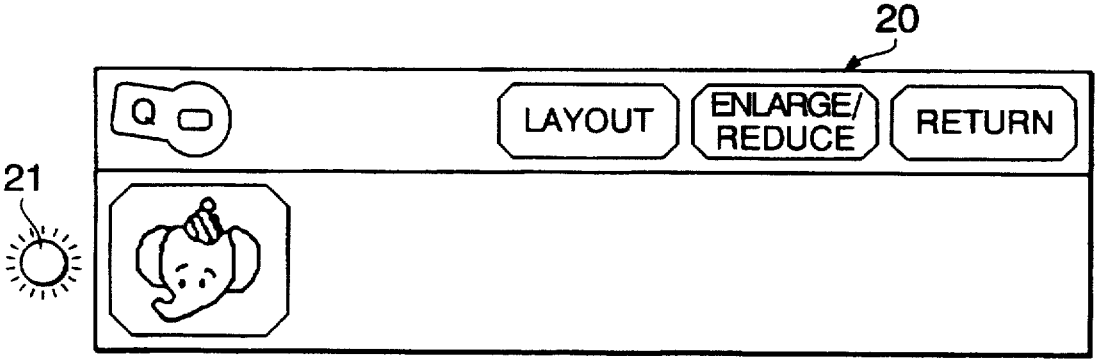
FIG. 10C is a screen image when the thread color of the last part of the embroidery pattern (elephant) is indicated by a color indicator.

When the final component is positioned at the leftmost position as shown in FIG. 10C, and embroidering therefor is finished (S43:YES; S44:YES), control returns to the one point pattern displaying process. Since the color indicating process is finished, the one point pattern displaying process is also finished, and therefore control returns to the embroidery pattern displaying process shown in FIG. 4, and proceeds to S10.

In the above-described processes, if the color of the thread to be used is black, the color indicator 21 is controlled to turn OFF.

If the pattern selected by the user at Sll is not the one point embroidery pattern, i.e., the letters and symbols category is selected (S12:NO; S13:YES), then a letter and symbol pattern displaying process is executed at S15. In the letter and symbol pattern displaying process, the user selects one or a plurality of letters and/or symbols displayed on the LCD 20, and determines the color thereof. Thereafter, similarly to the one point pattern displaying process, the selected letters and/or symbols are aligned on the LCD 20, and the color of the leftmost one is indicated by the color indicator. When the embroidering of the leftmost letter and/or symbol is finished, the image thereof disappears, and the remaining letters and/or symbols are shifted leftward.

Control of color indication performed by the color indicator 21 will be described further.

As described above, one of the one point embroidery patterns is selected, the components having different colors are displayed on the LCD 20. Further, the color of the component displayed at the leftmost position on the LCD 20 is indicated by the color indicator 21. At completion of the embroidering of the component displayed at the leftmost position on the LCD 20, the component to be embroidered subsequently is located at the leftmost position on the LCD 20, and the thread color thereof is indicated by the color indicator 21. Since the color indicator 21 is provided adjacent to the LCD 20, and the color indicator 21 indicates the color of the thread for forming the pattern which is displayed adjacent to the color indicator 21, with only one color indicator 21, colors for every component can be indicated, and indication thereof is not confusing since the image of the components are subsequently shifted so that the image of the component which thread color is to be indicated is located next to the color indicator 21.

Further, since the color is indicated with use of three LEDs, the size of the indicator can be made small, the control of displaying color is simplified, and manufacturing cost thereof can be reduced.

Furthermore, since the color indicator is separately provided, a display for displaying the image of the component can be made of a monochrome LCD which reduces the manufacturing cost. Further, since the patterns are displayed on the monochrome displaying device, no HALATION occurs and a clear image can be shown regardless of the color of the pattern and the cloth on which the embroidery is formed.

Figure 11:
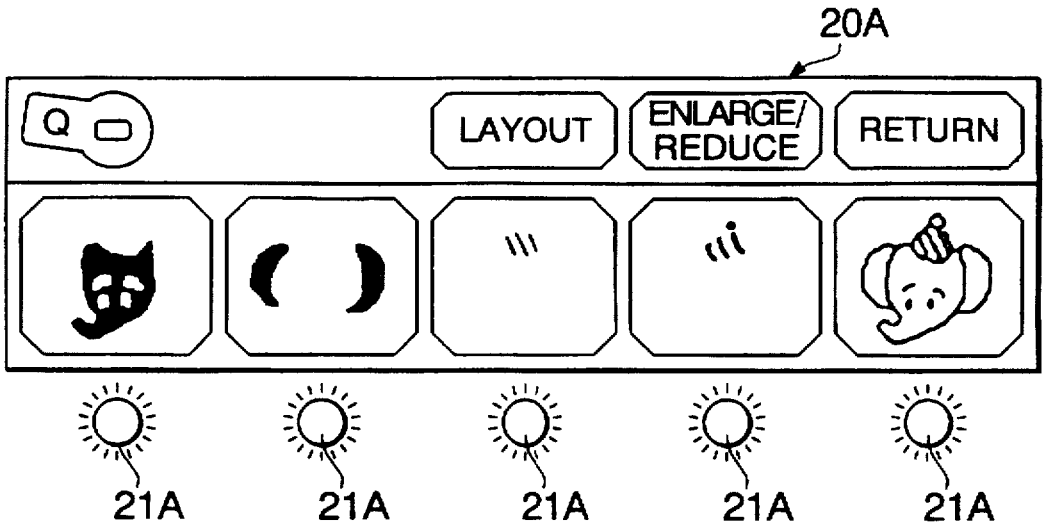
FIG. 11 shows an alternative embodiment where the thread color of each part of the embroidery is indicated by respective color indicators.

FIG. 11 shows an LCD 20A of an alternative embodiment of the embroidery data processing device.

In the alternative embodiment, a plurality of color indicators 21A are provided below the plurality of component images. With this structure, the colors of the plurality of components can be indicated simultaneously.

In the embodiment, the color indicator 21 is used only for indicating the thread color of the embroidery. It is also possible to use the indicator as an alarm lamp, pilot lamp, speed monitor lamp and the like. When the indicator 21 is used as the alarm lamp, it is possible to control the indicator to emit green light when the sewing machine operates normally, and to emit red light when error occurs. When the indicator 21 is used as the pilot lamp, it may be possible to control the indicator 21 to emit green light when sewing is not executed (i.e., the sewing machine is in a stand-by state), and to emit red light when the sewing is executed. When the indicator 21 is used as the speed monitor lamp, it may be possible to control the indicator 21 to blink, and changes the blinking period in accordance with the sewing speed.

It is also possible to use the card ROM 24 to store only the embroidery pattern image data, and make the CPU 30 to calculates the stitching points by analyzing the image data. Alternatively, it may be possible to store a data which can be converted into both the image data and the stitching data in the card ROM 24, and make the CPU 30 to develop both data based on the data stored in the card ROM 24.

Furthermore, it is possible to modify the embodiment described above based on conventionally known arts. Further, the invention can be applied not only the sewing machine having various driving mechanisms as described above, any kind of embroidery data processing devices which do not have the sewing or cloth feeding mechanisms.

The present disclosure relates to subject matter contained in Japanese Patent Application No. HEI 7-309942, filed on Nov. 4, 1995, which is expressly incorporated herein by reference in its entirety.

What is claim is:

1. An embroidery data processing device, comprising:

a displaying device for displaying a monochrome image of at least one partial embroidery pattern in accordance with partial embroidery data;

at least one indicator, provided separately from said monochrome image displayed on said displaying device, for displaying a color of a thread which is to be used for forming said at least one partial embroidery pattern displayed on said displaying device.

2. The embroidery data processing device according to claim 1, wherein said indicator indicates said color by emitting light having said color.

3. The embroidery data processing device according to claim 2, wherein said indicator has a plurality of LEDs (Light Emitting Diodes) capable of emitting a plurality of colors, respectively, and wherein said light having said color is a combination of lights emitted by said plurality of LEDs.

4. The embroidery data processing device according to claim 1, wherein said partial embroidery pattern includes a plurality of components to be embroidered with threads having different colors, and wherein said at least one indicator indicates a color of one of said components.

5. The embroidery data processing device according to claim 4, wherein said at least one indicator indicates a color of a component displayed at a predetermined position on said displaying device, and wherein said at least one indicator and said displaying device are arranged such that said at least one indicator is closer to said image displayed at said predetermined position than to other images.

6. The embroidery data processing device according to claim 1, wherein said partial embroidery pattern includes a plurality of components to be embroidered with threads having different colors, and wherein said at least one indicator has a plurality of indicators, said plurality of indicators indicate colors of threads to be used for embroidering said plurality of components, respectively.

7. The embroidery data processing device according to claim 6, wherein images of said plurality of components are arranged in a line, and said plurality of indicators are arranged to be located adjacent to respective images of said components.

8. The embroidery data processing device according to claim 7, wherein said plurality of indicators indicate colors of said threads to be used for embroidering said plurality of components, respectively and simultaneously.

9. An embroidery data processing device, comprising:

a memory for storing partial embroidery data for a plurality of partial embroidery patterns and threads to be used for forming said plurality of partial embroidery patterns;

a selector for selecting one of said partial embroidery patterns;

a displaying device for displaying a monochrome image of said one of said partial embroidery patterns selected by said selector;

an indicator capable of indicating on said displaying device a plurality of colors, said indicator being provided separately from said monochrome image displayed on said displaying device; and a controller for said indicator, said controller controlling said indicator to indicate a color of a thread to be used for forming said selected one of said partial embroidery patterns based on said embroidery data.

10. The embroidery data processing device according to claim 5 further comprising means for removing an image displayed at said predetermined position when embroidering of said image displayed at said predetermined position is completed and for displaying at said predetermined position an image of remaining components to be embroidered.

* * * * *